United States Patent [19]

Browning

[11] 4,343,605

[45] Aug. 10, 1982

[54] METHOD OF DUAL FUEL OPERATION OF AN INTERNAL BURNER TYPE ULTRA-HIGH VELOCITY FLAME JET APPARATUS

[75] Inventor: James A. Browning, Hanover, N.H.

[73] Assignee: Browning Engineering Corporation, Hanover, N.H.

[21] Appl. No.: 152,963

[22] Filed: May 23, 1980

[51] Int. Cl.[3] ..... F23C 5/00; F23M 3/02

[52] U.S. Cl. ..... 431/8; 431/4; 431/10; 431/158; 431/351

[58] Field of Search ..... 431/4, 5, 8, 10, 157, 431/158, 351, 352, 353

[56] References Cited

U.S. PATENT DOCUMENTS

| | | | |
|---|---|---|---|
| 2,416,161 | 2/1947 | Deck | 431/4 |
| 3,298,785 | 1/1967 | Reul | 431/4 X |
| 3,843,307 | 10/1974 | Staudinger | 431/8 |
| 3,907,488 | 9/1975 | Takahashi et al. | 431/4 X |
| 4,127,387 | 11/1978 | Vanderneen et al. | 431/8 X |

*Primary Examiner*—Larry Jones

*Attorney, Agent, or Firm*—Sughrue, Mion, Zinn, Macpeak & Seas

[57] ABSTRACT

An elongated casing forming a combustion chamber and bearing a venturi type jet nozzle at one end and a fuel and compressed air supply at its opposite end, bears one or more radial passages opening to the venturi to permit a secondary fuel to feed into the flame exiting from the burner for reaction with free oxygen which is unburned from the primary fuel and air mixture entering the combustion chamber at said opposite end of the apparatus. The secondary fuel may be acetylene, methyl-acetylene and its compounds with hydrogen.

3 Claims, 1 Drawing Figure

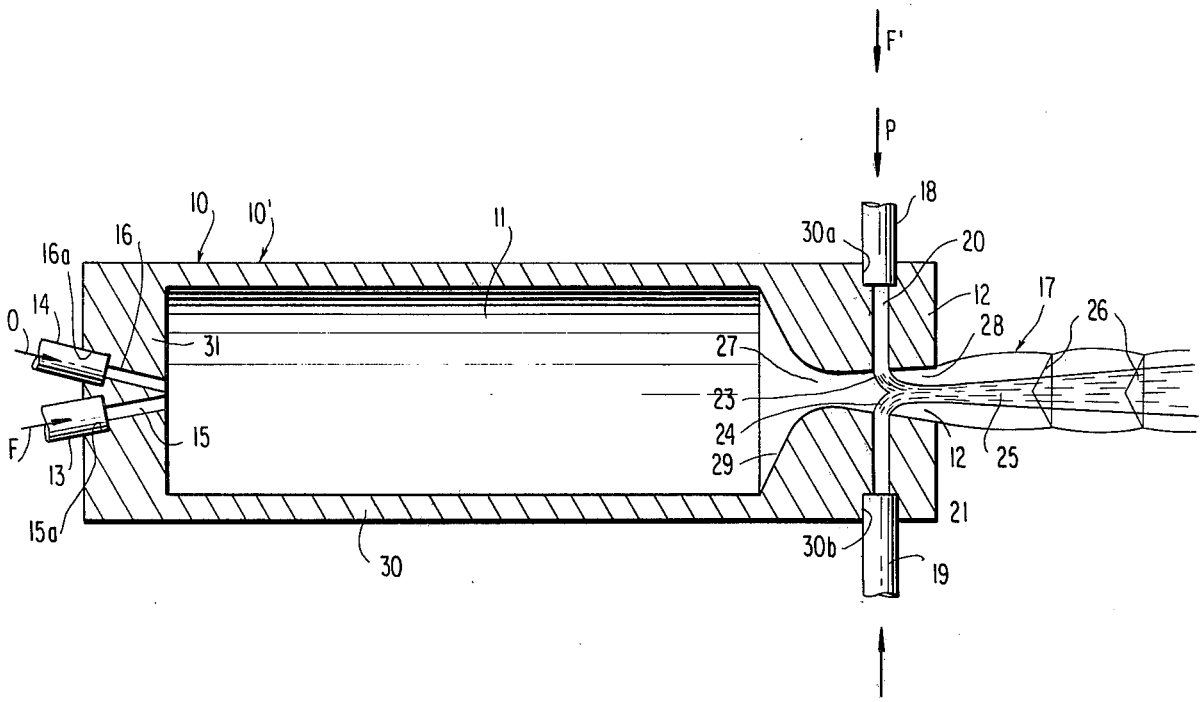
F'
P
18
10
10'
11
30a
20
16
16a
12
17
14
26
O
28
31
27
23
24
F
15
29
12
25
13
21
15a
30b
30
19

METHOD OF DUAL FUEL OPERATION OF AN INTERNAL BURNER TYPE ULTRA-HIGH VELOCITY FLAME JET APPARATUS

FIELD OF THE INVENTION

This invention relates to air/fuel internal burners employed in the creation of ultra-high velocity flame jets, and more particularly to a flame jet apparatus method of operation which employs in addition to a primary fuel, a secondary fuel for increasing the temperature of the high velocity flame jet discharging from the apparatus.

BACKGROUND OF THE INVENTION

In such internal burner devices which utilize an oxydizing fluid and a fuel to create a high velocity flame jet, the reactants burn at elevated pressure within a confining combustion chamber, and the products expand to ambient atmospheric pressure through a nozzle bearing an axial hole at one end of the internal burner of venturi form. Jet velocities well above sonic velocities (measured at jet temperature) are produced.

Such internal burners are used for applications including rock cutting, melting and spraying metal or ceramic particles to form a coating on a surface, spheridizing small angular particles of metal or ceramic and the like. Such internal burner type ultra-high velocity flame jet apparatus is set forth in my earlier U.S. Pat. No. 2,990,653 entitled "Method and Apparatus for Impacting a Stream of High Velocity Against the Surface to be Treated" issuing July 4, 1961. The apparatus of that patent takes the form of an air cooled double or triple wall cylindrical internal burner whose interior forms a combustion chamber, one end of which is closed off by a reduced diameter flame jet nozzle. At its opposite end, a fuel/air mixture is ignited with introduced fuel mixing with a continuous pressurized flow of air to materially increase the temperature of the continuous flowing stream prior to discharge and pressure reduction at high velocity through the nozzle bore. Combustion of the fuel/air mixture is effected by the incorporation of a spark plug within the cylindrical internal burner body forming part of a spark ignition system.

The present invention plays an important part in the flame coating field and utilizes the modified internal burner type ultra-high velocity flame jet apparatus and the description of the invention, which has broader aspects, is described in conjunction with the flame coating. However, the principles of the invention are also applicable to the other fields discussed above.

SUMMARY OF THE INVENTION

The present invention is directed to a method of operation to increase significantly the temperature level of an expanded flame jet. In particular, a secondary fuel flow is added to an oxydizing flame jet such that any "free" oxygen within the flame jet is consumed by the secondary fuel to increase the static temperature of the jet. Of particular advantage, is the use of a very reactive secondary fuel of high flame temperature. This fuel may be unsuitable for direct firing in the combustion chamber for one of various reasons but is highly effective in increasing the static temperature of the jet at its area of discharge from the venturi nozzle at the downstream end of the combustion chamber.

The method furthers include the feeding of atmospheric oxygen to mix with the combined secondary fuel and primary fuel and air products of combustion from the combustion chamber proper to increase the reduction of secondary fuel over that occurring by utilization of the flame jet from the primary fuel and air mixture, alone. The secondary fuel may be selected from the class consisting of acetylene, methylacetylene and its compounds, and hydrogen.

BRIEF DESCRIPTION OF THE DRAWING The single FIGURE is a longitudinal sectional view of an internal burner type ultra-high velocity flame jet apparatus operating under a method wherein secondary fuel is supplied to the oxydizing flame jet and forming one embodiment of the present invention.

DESCRIPTION OF THE PREFERRED EMBODIMENT

Referring to the drawing, a better understanding of the principles of this invention may be gauged by an inspection of that FIGURE, which is a longitudinal sectional view of an internal burner used to melt and project a flow of fusible particles to build up a coating of such molten particles on a surface (not shown) downstream of the discharge end of the apparatus illustrated.

In this FIGURE, an improved internal burner type ultra-high velocity flame jet apparatus indicated generally at 10 takes the form of an internal burner 10' comprised of a cylindrical section 30 which is closed off at its upstream end by a cylindrical injector piece 31 and closed off at its downstream end by an exit nozzle piece 12, thus forming a combustion chamber 11 internally of burner 10'. The nozzle piece 12 is provided with an axial nozzle bore or opening, being of supersonic flow design and having a throat 27 followed by an expanding discharge passage 28 and a converging inlet passage 29 leading to throat 27. The discharge passage 28, the throat 27 and the converging inlet passage 29 of the nozzle piece 12 defines a nozzle flow path of venturi shape. The injector piece 30 is provided with inclined injector holes at passages 15 and 16 which open to the interior of the combustion chamber 11 at a point which is in general axial alignment with the venturi discharge path for nozzle piece 12, the injector holes 15 and 16 being of relatively small diameter but enlarged at **15*a* and 16*a*, which enlarged portions receive respectively the ends of fuel supply tube 13 and an oxydizer supply tube 14**.

Thus, reactants including a fuel as indicated by arrow F and an oxydizer as indicated by arrow O are fed into the combustion chamber 11 with ignition and combustion taking place within the chamber 11 and the heated products of combustion pass from the nozzle piece 20 to form a supersonic flame jet indicated generally at 17 characterized by shock diamonds 26. The ignition means is not shown but may be similar to that of U.S. Pat. No. 2,990,653 previously discussed.

Assuming that the primary fuel flow to the combustion chamber 11 to be propane and the oxydizer comprising pure oxygen, a pressure level of combustion of 50 psig will produce a flame jet velocity of about 4,160 feet per second. These calculations assume an overall combustion and expansion efficiency of 80 percent. The energy for rapid expansion of the products of combustion comes from the internal energy of those gases. For example, the combustion flame temperature of 4,600° F. reduces to 3,500° F. in the jet. High melting point particles indicated schematically by arrow P may be introduced into these flowing gases as for instance by way of a tube 18 which passes through a hole 30*a* within the cylinder 30 and which opens to a smaller diameter passage 20. Passage 20 extends radially through nozzle piece 12 and opens generally perpendicular to the axis of the venturi path defined by passage sections 27, 28, 29 of nozzle piece 12. Alternatively, a tube 19 which is illustrated as being diametrically opposite to tube 18, and being positioned within a second hole 30*b* in radial alignment with hole 30*a* may also supply particles, via passage 21 for introduction into the flowing gases of the flame jet 17 in the area of the diverging jet nozzle exit passage 28. However, the introduction of these particles may be achieved without the particles melting due to the limitation of the 3,500° F. jet.

The present invention is directed to a method and apparatus for increasing the jet temperature by adding a reactive fuel to the gases flowing through nozzle 12. The secondary fuel flow can be achieved by use of either tube 18 and hole 20 or tube 19 and hole 21, or by both simultaneously if desired or necessary. To provide oxygen for combuting this secondary fuel, one of three arrangements may be employed. The main combustion reaction (using the primary fuel flow) can be purposely made "clean". Oxygen and the products of combustion are available to burn the secondary fuel. Or the secondary fuel may be pre-mixed with oxygen and fed through either or both tubes 18, 19. Further, the secondary fuel may be added through one of the radial passages as at 20, for instance, to the jet flame, while oxygen may be added by way of the other radial passage 21.

Although a single injection stream of secondary fuel F′ may be effected via tube 19, opposing jets (as shown in the FIGURE) assures axial flow of this secondary fuel in the main flame jet stream. With single injection from one side only, just the right flow velocity must be maintained. Alternatively, axial injection (not shown) can be quite effective in producing the desired increase in jet temperature and the metalization of high melting point particles introduced to the flowing gas stream 17 at the discharge end of nozzle piece 12.

The secondary fuel burns to form a relatively small diameter intensely hot core region within the main jet 17. This core expands until essentially complete mixing takes plae. A powder of fusible material P entering with the secondary fuel flow, also applied to tube 18 in the FIGURE, will follow the gaseous core path of increased temperature. Where acetylene is the secondary fuel, initial core temperatures over 5000° F. may result. Thus, many of the most refractory materials can be melted. Acetylene, methyl-acetylene and other very reactive fuels containing multiple-bonded carbon atoms cannot serve as the primary fuel. However, they are more than adequate as the secondary fuel in this case. High pressure levels of combustion lead to pyrolysis and the release of free carbon which can plug combustion chamber 11.

Thus, the invention uses a primary stable fuel with a secondary more reactive fuel. An intially stratified dual jet flow is created, and the material to be heated may be exposed either to the hotter flow constituent or the combined flow of a temperature greater than that in the absence of the secondary fuel flow. The secondary fuel is added at a point along the flow path where the pressure is either atmospheric or near to it. Thus, formation of free carbon is suppressed. Acetylene which should not be pressurized above 15 psig may be employed as the secondary fuel and applied to the primary flame stream closely adjacent the discharge end of the flame jet, that is, in the vicinity or within the diverging exit passage 28 within the nozzle piece 12.

An alternative use of the secondary fuel flow resides in its function of reducing the oxygen content of the primary products flame jet. Hydrogen is a very useful gas for this purpose. In this case, the primary reactants ratio are set to reduce oxygen levels of the flame jet to its minimum possible value, i.e., running richer that stoichiometric. The remaining oxygen will then be greatly reduced by the secondary hydrogen. In addition, oxygen aspirated from the surrounding air into the jet is also neutralized.

Although the FIGURE illustrates a double-injection of the secondary fuel F′, other injection geometries are useful. In particular, continuous circumferential injection or use of many closely spaced holes to form an envelope around the flame jet has proven to be the most effective although obviously more costly in terms of feeding requirements and additional passages other than the two shown at 20, 21 in the illustrated embodiment.

As mentioned previously, one of the passages 21 and thus supply tube 19 may be open to the atmosphere, providing the means for aspiration of secondary air into the stream at the point where additional fuel is supplied by way of the other passage as at 20.

While the present invention has been described in conjunction with an internal burner type ultra-high velocity flame jet apparatus, the reducing capability of the secondary fuel may follow the principles set forth above and function adequately with different types of combustion systems, including open flame (welding flame) burners.

While the invention has been particularly shown and described with reference to a preferred embodiment thereof, it will be understood by those skilled in the art that various changes in form and details may be made therein without departing from the spirit and scope of the invention.

What is claimed is:

1. In a method of burning a primary fuel with an oxydizer within a combustion chamber bearing a venturi type jet nozzle at one end remote from the opposite end in which the primary fuel and oxydizer is ignited to form a flame jet exiting from the nozzle, and wherein small particles of metal or ceramic are fed radially to the venturi for particle spraying at jet velocity, the improvement comprising the step of:

reacting a secondary fuel with higher reactivity than that of said primary fuel with the "free oxygen" within the flame jet exiting from said burner to reduce oxidation of sprayed prticles and increase the static temperature of the flame jet bearing said particles.

2. The method as claimed in claim 1, further comprising the step of:

aspirating atmospheric oxygen into the flame jet issuing from a burner to cause said combined flow to be more reducing than said flame alone by utilization of its free oxygen content to reduce secondary fuel.

3. The method as claimed in claim 1 or claim 2, wherein said step of reacting a secondary fuel with "free oxygen" within the flame exiting from said burner comprises the feeding of one secondary fuel selected from the group consisting of acetylene, methyl-acetylene and its compounds, and hydrogen to said flame exiting from said burner.

* * * * *